US008579586B2

(12) United States Patent
Kim

(10) Patent No.: US 8,579,586 B2
(45) Date of Patent: Nov. 12, 2013

(54) BELL MOUTH FOR SCROLL CASE

(75) Inventor: Jaewon Kim, Chungcheongnam-do (KR)

(73) Assignee: Industry-University Cooperation Foundation Sunmoon University, Asan-si, Chungcheongnam-do (KR)

( * ) Notice: Subject to any disclaimer, the term of this patent is extended or adjusted under 35 U.S.C. 154(b) by 640 days.

(21) Appl. No.: 12/845,038

(22) Filed: Jul. 28, 2010

(65) Prior Publication Data

US 2012/0009057 A1 Jan. 12, 2012

(30) Foreign Application Priority Data

Jul. 9, 2010 (KR) ..... 10-2010-0066098

(51) Int. Cl.
*F04D 29/42* (2006.01)

(52) U.S. Cl.
USPC ..... 415/204

(58) Field of Classification Search
USPC ..... 415/203, 204, 206
See application file for complete search history.

(56) References Cited

U.S. PATENT DOCUMENTS

| | | | | | |
|---|---|---|---|---|---|
| 820,398 | A * | 5/1906 | Davidson | 415/204 |
| 3,407,995 | A * | 10/1968 | Kinsworthy | 415/94 |
| 2008/0107523 | A1* | 5/2008 | Chen et al. | 415/206 |
| 2011/0189004 | A1* | 8/2011 | Dybenko et al. | 415/203 |

FOREIGN PATENT DOCUMENTS

| | | | |
|---|---|---|---|
| JP | 9-126193 | * | 5/1997 |
| JP | 2000-179496 | A | 6/2000 |

OTHER PUBLICATIONS

Kameoka et al., Centrifugal Blower, May 13, 1997, Absract of JP9-126193.*

Sheam-Chyun Lin, et al; "An Integrated Experimental and Numerical Study of Forward-Curved Centrifugal Fan", Experimental Thermal and Fluid Science 26 (2002) pp. 421-434.

* cited by examiner

*Primary Examiner* — Edward Look
*Assistant Examiner* — Liam McDowell
(74) *Attorney, Agent, or Firm* — Ladas & Parry LLP

(57) ABSTRACT

A bell mouth for a scroll case according to an exemplary embodiment of the present invention is a bell mouth which is provided on the top plate of the scroll case to form an air inlet in order to allow air flow into the scroll case by a centrifugal blower installed inside the scroll case, and the volume of two parts of the bell mouth in respect to a rotation shaft of the centrifugal blower is different from each other. According to the present invention, it is possible to minimize generation of reverse flow of inflow air by increasing or decreasing a variation of the cross-section area of the bell mouth according to an increase in the pressure of the flow rate.

4 Claims, 5 Drawing Sheets

BELL MOUTH FOR SCROLL CASE

CROSS REFERENCE TO RELATED APPLICATIONS

This application claims priority to Korean Patent Application No. 10-2010-0066098 filed on Jul. 9, 2010, the entire contents of which are herein incorporated by reference.

BACKGROUND OF THE INVENTION

1. Field of the Invention

The present invention relates to a bell mouth for a scroll case, and more particularly, to a bell mouth for a scroll case having an asymmetric geometry in which the volume of the bell mouth partially increases in the vicinity of a cut off part of the scroll case.

2. Description of the Related Art

In centrifugal blowers that include a scroll case and are widely used as air movement system, gradual expansion of a flow path structure of a scroll case causes energy conversion between pressure energy and kinetic one.

A flow is induced due to a low pressure generated by rotation of a centrifugal blower. However, in a case of some flow regions, reverse flows in axial direction of a centrifugal blower may occur due to nonuniform pressure distribution in circumstance direction. In order to suppress such a reverse flow, extra volume for flows is provided by a bell mouth.

Meanwhile, in a region having an extremely small cross-section area along a flow path of a scroll case, an increase in kinetic energy corresponding to an increase in a flow rate reduces in static pressure in order for satisfaction of energy conservation.

However, it is a well-known fact that if an increase in a flow rate exceeds a predetermined limit, a reverse flow due to an excessive flow rate at a cross-section of a scroll case is observed.

In this case, artificial generation of a low-pressure part by the bell mouth prevents a loss of a flow rate. However, a general bell mouth cannot accomplish this unique object over the entire region nor prevent generation of a reverse flow since it keeps both uniform cross-sectional shape and volume along the circumference.

Since noise and air volume generated in a centrifugal blower vary quite sensitively according to design of a scroll case including bell mouth, researches concerning design of a high-efficiency scroll case or bell mouth are being required in order to reduce noise and increase air volume.

SUMMARY OF THE INVENTION

The preset invention has been made in an effort to provide a bell mouth for a scroll case having an asymmetric geometry in which the volume partially increases in the vicinity of a cut off part of the scroll case.

An exemplary embodiment of the present invention provides a bell mouth for a scroll case which is provided on the top plate of the scroll case to form an air inlet in order to allow air flow into the scroll case by a centrifugal blower installed inside the scroll case, wherein the volume of two parts of the bell mouth in respect to a rotation shaft of the centrifugal blower is different from each other.

The scroll case may include a scroll part having an air flow path on the outside of a centrifugal blower, an outflow part connected to the scroll part and extended toward an outlet of the scroll part, and a cut off part that is a beginning part of the scroll part, where the air flow path begins to be enlarged, and when an angle of a line, parallel to the extending direction of the outflow part, among lines extending from the center of the centrifugal blower to the outline of the scroll case is set as a reference angle, the radius of the bell mouth may vary as a position determining angle of an azimuthal plane increases from the reference angle to the position determining angle of the cut off part.

A range from the reference angle to the position determining angle of the cut off part may include a first angle range from the reference angle to a predetermined position determining angle, and a second angle range from the predetermined position determining angle. In the first angle range, the radius of the bell mouth may decrease as the position determining angle increases, and in the second angle range, the radius of the bell mouth may increase as the position determining angle increases.

When the position determining angle of the azimuthal plane from the reference angle is $\Psi$ and the position determining angle of the cut off part is $\Psi c$, the radius $R(\Psi)$ of the bell mouth according to the position determining angle $\Psi$ may meet the following Equation:

$$R(\Psi) = R_0 - A_r \mathrm{Sin}\left(\frac{\pi}{\Psi_c}\Psi\right), \qquad \text{[Equation]}$$

wherein $R_0$ is a reference radius from the center of the centrifugal blower to the bell mouth, and Ar is the ratio of the flow path cross-section area Ae of the scroll case at the outflow part to the flow path cross-section area Ac of the scroll case at the cut off part.

The Ar may be equal to or greater than 1.6 and equal to or less than 1.8.

According to the exemplary embodiments of the present invention, since the bell mouth is configured to have a geometry asymmetric to the rotation shaft of the centrifugal blower, not a symmetric shape, it is possible to minimize generation of reverse flow of inflow air by increasing or decreasing a variation of the volume along the circumference of the bell mouth according to an increase in the pressure of the flow rate.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
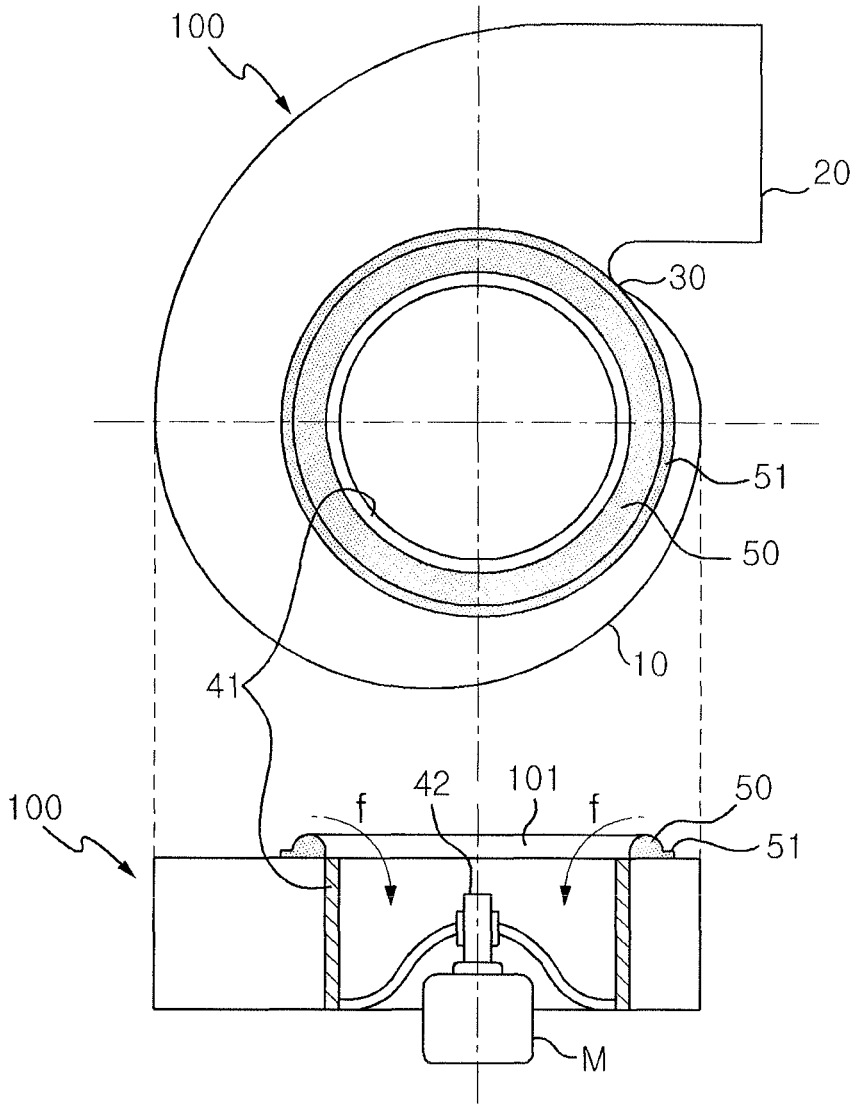
FIG.1 (PRIOR ART)
FIG. 1 is a schematic view illustrating a scroll case according to a comparative example of the present invention.

Hereinafter, exemplary embodiments of the present invention will be described in detail with reference to the accompanying drawings. Identical or corresponding components are designated by the same reference numerals and their detailed description is omitted.

Figure 2:
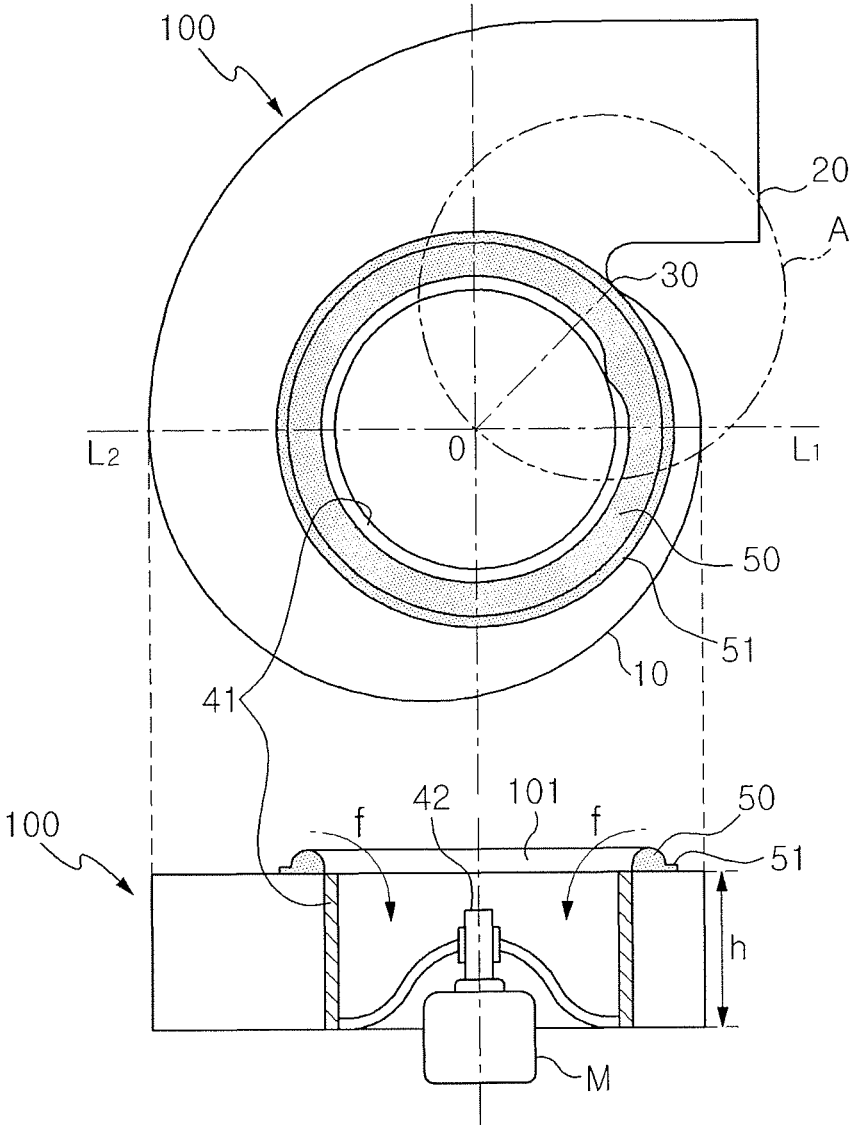
FIG. 2 is a schematic view illustrating a scroll case according to an exemplary embodiment of the present invention.
Figure 3:
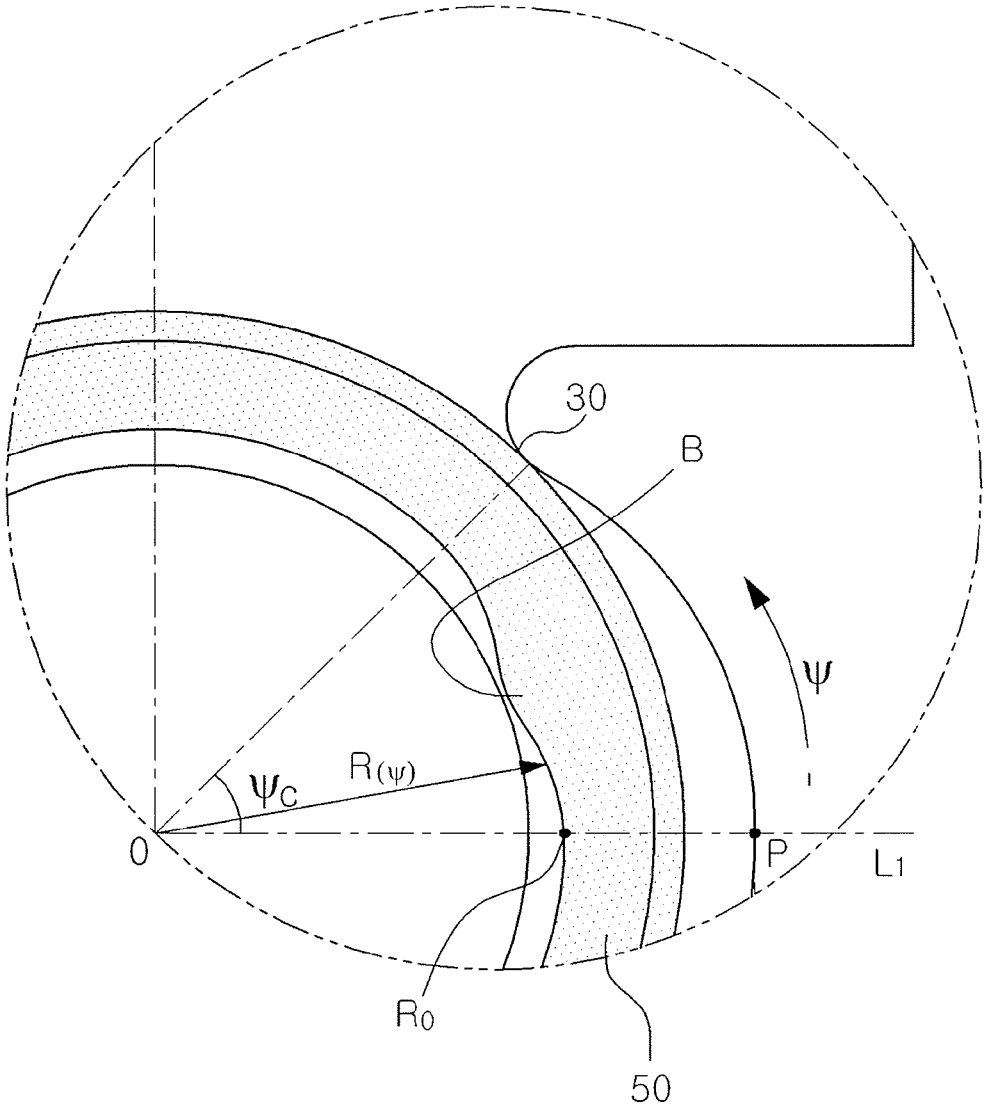
FIG. 3 is an expanded cross-sectional view illustrating a region 'A' of a bell mouth shown in FIG. 2.
Figure 4:
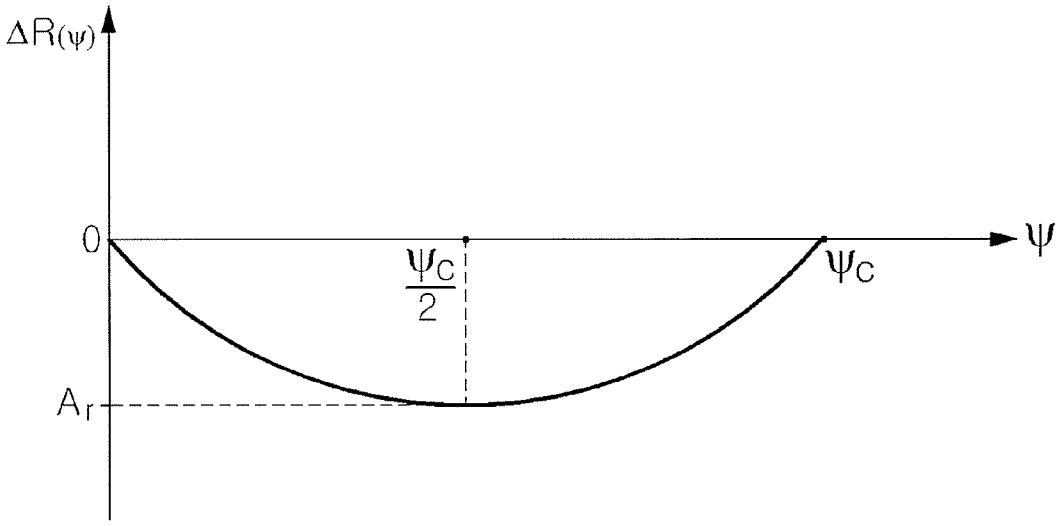
FIG. 4 is a graph for explaining a radius of a region 'B' of the bell mouth shown in FIG. 3.

FIG. 1 is a schematic view illustrating a scroll case according to a comparative example of the present invention, FIG. 2 is a schematic view illustrating a scroll case according to an exemplary embodiment of the present invention, FIG. 3 is an expanded cross-sectional view illustrating a region 'A' of a bell mouth shown in FIG. 2, and FIG. 4 is a graph for explaining a radius of a region 'B' of the bell mouth shown in FIG. 3.

Referring to FIGS. 1 and 2, a scroll case 100 according to an exemplary embodiment of the present invention includes a scroll part 10 having an air flow path on the outside of a centrifugal blower 41, an outflow part 20 connected to the scroll part 10 and extending toward an outlet of the scroll part 10, and a cut off part 30 that is a beginning part of the scroll part 10, where the air flow path begins to be enlarged.

Here, the scroll part 10 means a flow path part from the cut off part 30 where air induced by guidance of the bell mouth 50 is gradually expanded, and the outflow part 20 is designed to be connected to the scroll part 10 and extending toward the outlet of the scroll part 10.

Pressure conversion is accomplished by configuring the structure of the scroll part 10 to have a flow path gradually expanded from the cut off part 30 as described above, which makes it possible to discharge a flow rate having a predetermined pressure through the outflow part 20.

The cut off part 30 so called a cut-off region means a part from which the scroll part 10 begins, in which clearance with the inner surface of the scroll part 10 and the outer surface of the centrifugal blower 41 is minimal, as shown in FIG. 2, and is a position where expansion of a main flow starts.

The scroll case 100 includes a bell mouth 50 provided on the top plate of the scroll case 100 to form an air inlet 101 in order for air to be induced to the inside by the centrifugal blower 41 provided inside.

The bell mouth 50 is formed to roundedly project upward from the top plate of the scroll case 100, and a part denoted by reference numeral 51 in FIG. 2 means a base plate of the bell mouth 50.

In order to prevent a reverse flow of the direction of a rotation shaft 42 of air induced into the scroll case 100, an artificial low-pressure part is generated by the bell mouth 50.

Meanwhile, in order to forcibly suck air into the scroll case 100 by the centrifugal blower 41, the rotation shaft 42 of the centrifugal blower 41 is connected to a motor M that is a drive, and is provided inside the scroll part 10.

Rotation of the centrifugal blower 41 creates low pressure within the centrifugal blower 41, which makes air be sucked in the direction of the rotation shaft 42 of the centrifugal blower 41 as shown by a reference symbol 'f' in FIG. 2, and is sent in a radial direction of the centrifugal blower 41. The sent air flows along the inner wall surface of the scroll part 10 and is discharged to the outside of the scroll case 100 through the outflow part 20.

That is, if the centrifugal blower 41 rotates, air sent in the radial direction of the centrifugal blower 41 flows from a beginning part of the scroll part 10 to the outflow part 20 while rotating in a rotation direction of the centrifugal blower 41 along the inner wall surface of the scroll part 10.

The bell mouth 50 for a scroll case according to the exemplary embodiment of the present invention is characterized in that the volumes of both parts in respect to the rotation shaft 42 of the centrifugal blower 41 are different from each other.

Specifically, referring to FIG. 2, among lines extending from the center 'o' of the centrifugal blower 41 to the outline of the scroll case 100, there exist two lines $L_1$ and $L_2$ parallel to an extending direction of the outflow part 20. An angle of a point (a point 'P' shown in FIG. 3) where the line $L_1$, which extends in the same direction as the extending direction of the outflow part 20, of the two lines $L_1$ and $L_2$ meets a curved surface forming the outline of the scroll case 100 is set to a reference angle, that is, 0°.

The radius R determining the volume of the bell mouth 50 provided in the scroll case 100 may be defined as a distance from the center 'o' of the centrifugal blower 41 to the bell mouth 50 as shown in FIG. 3.

The technical features of the radius of the bell mouth 50 according to the exemplary embodiment of the present invention are described. The radius R of the bell mouth 50 disposed in a region (a region 'A' shown in FIG. 2) from the reference angle to the cut off part 30 varies as the position determining angle Ψ of an azimuthal plane increases from the reference angle to the cut off part 30.

Referring to FIG. 3, when the position, determining angle of the azimuthal plane from the reference angle is Ψ and the position determining angle of the cut off part 30 is Ψc, the radius R of the bell mouth 50 of the region 'A' can be expressed as a function of the position determining angle Ψ increasing from the reference angle to the cut off part 30, and the radius R of the bell mouth 50 varies in response to an increasing position determining angle Ψ, which causes variation in the geometry (the shape and the volume) of the bell mouth 50. Therefore, the radius R of the bell mouth 50 may be considered as a geometric variable determining the shape and the volume of the bell mouth 50.

Since the radius R of the bell mouth 50 in the region 'A' varies as the position determining angle Ψ increases from the reference angle to the position determining angle of the cut off part 30, the geometry of the bell mouth 50 becomes asymmetric to the rotation shaft 42 of the centrifugal blower 41.

That is, the geometry of the bell mouth 50 in the region 'A' is different from the geometry of the remaining part of the bell mouth 50 outside the region 'A' such that the geometry of the bell mouth 50 is asymmetric. This structure creates room to handle an increase in the pressure caused by an increase in a flow rate in the bell mouth 50. Therefore, it is possible to minimize generation of reverse flow.

In contrast, in a case of a comparative example shown in FIG. 1, in a region, having an extreme small flow path cross-section area, of a flow path of a scroll case 100, kinetic energy increases as the flow rate increases, and as a result, an increase in static pressure is reduced. Therefore, a flow is smoothly induced. However, if an increase of a flow rate exceeds a predetermined limit, the excessive flow rate at the flow path of the scroll case 100 causes problems.

That is, since a bell mouth 50 according to the comparative example maintains an identical cross-section shape and an identical volume along the circumference, it cannot handle the flow rate in the flow path of the scroll case 100. As a result, it is difficult to prevent generation of reverse flow unlike the exemplary embodiment of the present invention.

The variation in the radius R of the bell mouth 50 according to the exemplary embodiment of the present invention will be described specifically. A position determining angle range from the reference angle to the position determining angle of the cut off part 30 is composed of a first angle range from the reference angle to a predetermined position determining angle and a second angle range from the predetermined position determining angle to the position determining angle of the cut off part 30. In the first angle range, the radius R of the bell mouth 50 decreases as the position determining angle Ψ increases, and in the second angle range, the radius R of the bell mouth 50 increases as the position determining angle Ψ increases.

Referring to a region 'B' shown in FIG. 3, the distance from the center 'o' of the centrifugal blower 41 to the bell mouth 50, that is, the radius R of the bell mouth 50 tends to decrease as the position determining angle Ψ increases. Accordingly, the volume of the bell mouth 50 tends to increase partially.

The radius R of the bell mouth 50 decreases in the first angle range and increases in the second angle range. Here, the first angle range means a range from the reference angle to the middle angle Ψc/2 of the position determining angle Ψc of the cut off part 30.

Specifically the functional relationship between the radius R of the bell mouth 50 and the position determining angle Ψ increasing from the reference angle to the position determining angle Ψc of the cut off part 30 can be expressed by the following Equation 1.

$$R(\Psi)=R_0+\Delta R(\Psi) \quad \text{[Equation 1]}$$

Here, referring to FIG. 3, $R_0$ is a fixed value meaning a reference radius from the center 'o' of the centrifugal blower 41 to the bell mouth 50, and ΔR(Ψ) is a variable meaning a value increasing or decreasing from the reference radius $R_0$.

Here, the ΔR(Ψ) can be expressed by the following Equation 2 which is plotted in FIG. 4.

$$\Delta R(\Psi) = -A_r \mathrm{Sin}\left(\frac{\pi}{\Psi_c}\Psi\right) \quad \text{[Equation 2]}$$

Here, Ψc represents the position of the cut off part 30 in the azimuthal plane, that is, the position determining angle of the cut off part 30, and Ar represents a coefficient that means the ratio of the flow path cross-section area Ae of the scroll case 100 at the outflow part 20 to the flow path cross-section area Ac of the scroll case 100 at the cut off part 30. They will be described below in detail.

Therefore, from Equation 1 and Equation 2, the functional relationship between the radius R of the bell mouth 50 and the position determining angle Ψ increasing the reference angle to the position determining angle Ψc of the cut off part 30 can be defined as the following Equation 3.

$$R(\Psi) = R_0 - A_r \mathrm{Sin}\left(\frac{\pi}{\Psi_c}\Psi\right) \quad \text{[Equation 3]}$$

According to Equation 3, in the first angle range, that is, in a range to the middle angle Ψc/2 of the position determining angle Ψc of the cut off part 30, the radius R of the bell mouth 50 decreases such that the cross-section area of the bell mouth 50 increases. In the second angle range, the radius R of the bell mouth 50 increases such that the cross-section area for the bell mouth 50 decreases. As such, the cross-section area and shape of the bell mouth 50 vary such that the radius R of the bell mouth 50 is plotted as a sine curve.

Since the cross-section area of the initial flow path gradually increases because of the features of the sine curve, it is possible to prevent a loss of flow energy due to a rapid variation of the cross-section area of the flow path.

Figure 5:
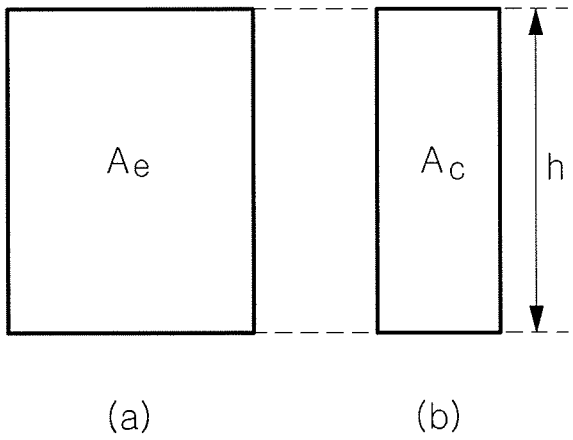
FIG. 5 is an explanatory drawing for explaining Ar (Ac/Ac) shown in FIG. 4.
Figure 6:
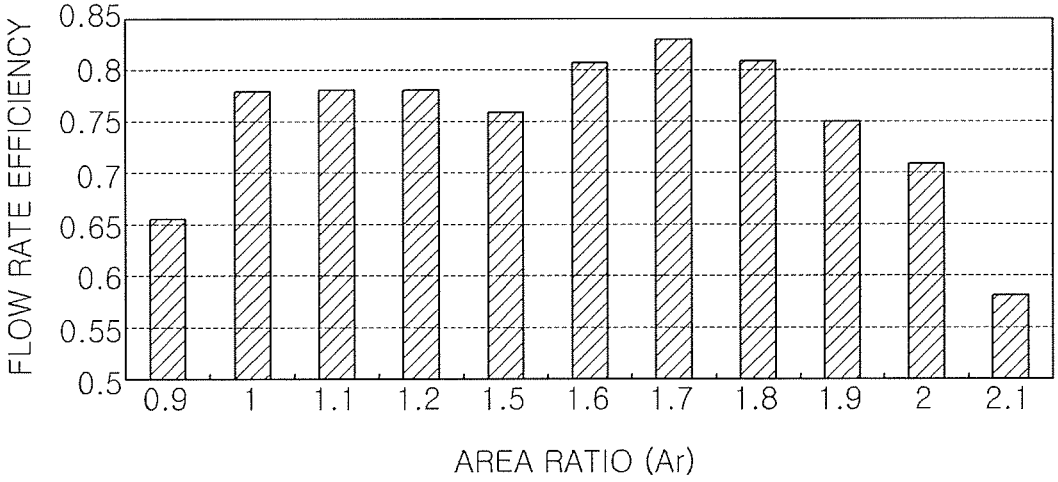
FIG. 6 is a plot illustrating the flow rate efficiency according to the range of Ar of a bell mouth according to an exemplary embodiment of the present invention.

FIG. 5 is an explanatory drawing for explaining Ar (Ac/Ac) shown in FIG. 4, and FIG. 6 is a plot illustrating the flow rate efficiency according to the range of Ar of a bell mouth according to an exemplary embodiment of the present invention.

The Ar shown in Equation 3 represents a coefficient meaning the ratio of the flow path cross-section area Ae of the scroll case 100 at the outflow part 20 to the flow path cross-section area Ac of the scroll case 100 at the cut off part 30 and is a value determining the amplitude of the sine curve of Equation 3.

The flow path cross-section area of the scroll case 100 increases in a curve shape of a continuous function. In this case, the increasing area ratio may be used to determine the maximum increment of the cross-section area of the bell mouth 50. A theoretical formula for that is expressed by the following Equation 4.

$$A_r = \frac{A_e}{A_c} \quad \text{[Equation 4]}$$

In Equation 4, assuming that the flow path cross-section area of the scroll case 100 at the outflow part 20 whose position determining angle Ψ is −3π/2 is Ae and the flow path cross-section area of the scroll case 100 at the cut off part 30 whose position determining angle is Ψc is Ac, Ar means the ratio of Ae to Ac.

Referring to FIG. 5, there are shown the flow path cross-section area Ae of the scroll case 100 at the outflow part 20, and the flow path cross-section area Ac of the scroll case 100 at the cut off part 30.

The height h of the scroll case 100 is constant and the Ar may be set by changing the flow path cross-section area Ac of the scroll case 100 at the cut off part 30. When Ar is 1.7, this means that the flow path cross-section area Ae of the scroll case 100 at the outflow part 20 is 1.7 times the flow path cross-section area Ac of the scroll case 100 at the cut off part 30.

The flow rate efficiency according to the range of Ar of the bell mouth 50 will be described with reference to FIG. 6. From FIG. 6, it can be seen that when the value of Ar is within a range of 1.6 to 1.8, the value of the flow rate efficiency representing the ratio of an amount of inflow air and an amount of outflow air is 0.8 or greater, and in particular, when the value of Ar is 1.7, the value of the flow rate efficiency is 0.83, which is the maximum.

A bell mouth obtained by setting 1.7, which is the value of Ar to maximize the flow rate efficiency, to the amplitude of Equation 3 has a shape in which the cross-section area increases in the vicinity of the cut off part 30 as shown in the region 'B' of FIG. 3.

In a case of adapting the structure of the bell mouth 50 according to the comparative example shown in FIG. 1, the flow rate was 23.5 $m^3$/min, and BPF (blade passing frequency) noise was measured 56.8 dB(A).

However, in a case of adapting the structure of the bell mouth 50 according to the exemplary embodiment of the present invention, the flow rate was 26 $m^3$/min, which improved by 2.5 $m^3$/min as compared to the comparative example, and the BPF noise was measured 51.0 dB. That is, it can be seen that reverse flow is prevented by removing a part where the static pressure excessively increases, and to remove wide band noise caused by vortex flow, resulting in a reduction of noise.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Accordingly, the actual technical protection scope of the present invention must be determined by the spirit of the appended claims.

What is claimed is:

1. A bell mouth for a scroll case, which is provided on a top plate of the scroll case to form an air inlet in order to allow air flow into the scroll case by a centrifugal blower installed inside the scroll case, wherein:

a volume of two parts of the bell mouth in respect to a rotation shaft of the centrifugal blower is different from each other;

the scroll case includes a scroll part having an air flow path on an outside of the centrifugal blower, an outflow part connected to the scroll part and extended toward an outlet of the scroll part, and a cut off part that is a beginning part of the scroll part, where the air flow path begins to be enlarged and when an angle of a line, parallel to an extending direction of the outflow part, among lines extending from a center of the centrifugal blower to an outline of the scroll case is set as a reference angle, a radius of the bell mouth varies as a position determining angle of an azimuthal plane increases from the reference angle to the position determining angle of the cut off part.

2. The bell mouth for a scroll case according to claim 1, wherein:

a range from the reference angle to the position determining angle of the cut off part includes a first angle range from the reference angle to a predetermined position determining angle, and a second angle range from the predetermined position determining angle, in the first angle range, the radius of the bell mouth decreases as the position determining angle increases, and in the second angle range, the radius of the bell mouth increases as the position determining angle increases.

3. The bell mouth for a scroll case according to claim 1, wherein:

when the position determining angle of the azimuthal plane from the reference angle is $\Psi$ and the position determining angle of the cut off part is $\Psi c$, the radius $R(\Psi)$ of the bell mouth according to the position determining angle $\Psi$ meets the following Equation:

$$R(\Psi) = R_0 - A_r \mathrm{Sin}\left(\frac{\pi}{\Psi_c}\Psi\right), \qquad \text{[Equation]}$$

wherein $R_0$ is a reference radius from the center of the centrifugal blower to the bell mouth, and $A_r$ is the ratio of the flow path cross-section area $A_e$ of the scroll case at the outflow part to the flow path cross-section area $A_c$ of the scroll case at the cut off part.

4. The bell mouth for a scroll case according to claim 3, wherein:

the $A_r$ is equal to or greater than 1.6 and equal to or less than 1.8.

* * * * *